US006213661B1

(12) United States Patent
Coon

(10) Patent No.: US 6,213,661 B1
(45) Date of Patent: Apr. 10, 2001

(54) RETRACTABLE FELT-TIPPED PEN

(76) Inventor: George Coon, 1436 Cambridge St., Cambridge, MA (US) 02139

( * ) Notice: Subject to any disclaimer, the term of this patent is extended or adjusted under 35 U.S.C. 154(b) by 0 days.

(21) Appl. No.: 09/146,647

(22) Filed: Sep. 3, 1998

Related U.S. Application Data

(60) Provisional application No. 60/057,420, filed on Sep. 3, 1997.

(51) Int. Cl.[7] ..... B43K 24/02

(52) U.S. Cl. ..... 401/108; 401/107

(58) Field of Search ..... 401/108, 107, 401/109, 110, 111, 112, 196, 198, 98

(56) References Cited

U.S. PATENT DOCUMENTS

| | | | | |
|---|---|---|---|---|
| 3,525,573 | | 8/1970 | Fend | 401/108 |
| 3,583,820 | | 6/1971 | Koeln | 401/107 |
| 4,618,280 | * | 10/1986 | Kageyama | 401/108 |
| 4,711,592 | | 12/1987 | Gregory | 401/107 |
| 4,969,764 | | 11/1990 | Gregory | 401/108 |
| 5,022,773 | * | 6/1991 | Waldinger et al. | 401/17 |
| 5,092,701 | | 3/1992 | Lai | 401/107 |
| 5,207,523 | | 5/1993 | Wittek | 401/107 |
| 5,823,697 | * | 10/1998 | Talbot | 401/108 |

* cited by examiner

*Primary Examiner*—David J. Walczak
(74) *Attorney, Agent, or Firm*—Foley, Hoag & Eliot LLP

(57) ABSTRACT

A retractable felt-tipped pen includes first and second cylindrical members movable with respect to each other and a pen nib connected to one of the first and second cylinders. A flexible membrane is connected to at least one of the first and second tubes and rotates inward on itself to engage the pen nib in a closed condition to seal the pen nib and rotates outward from itself to disengage the pen nib for writing and/or the membrane simply expands without rotation.

10 Claims, 14 Drawing Sheets

RETRACTABLE FELT-TIPPED PEN

This application claims benefit to U.S. provisional application Ser. No. 60/057,420, filed Sep. 3, 1997.

BACKGROUND OF THE INVENTION

1. Field of the Invention

This invention relates to writing implements, and more particularly to a felt-tipped writing implement such as a felt-tipped pen which has a self-sealing mechanism for enclosing the felt nib when not in use.

2. Description of the Related Art

Felt-tipped pens are well known in the art and typically include a felt nib connected to a reservoir of ink. Ink is supplied to the nib by capillary action and/or gravity. When the felt tipped pen is not in use, it is necessary for the pen to be sealed to prevent the ink from evaporating from the nib and to prevent the nib from contacting external surrounding surfaces, such as a desk or papers, and bleeding ink onto those surfaces.

Known felt-tipped pens are usually sealed using removable caps, which may be lost or misplaced. Alternatively, retractable felt-tipped pens have been designed, but these pens typically use very complex sealing mechanisms to seal the retracted pen nib in the pen body. Complex sealing mechanisms are undesirable since they are prone to failure. Further, the additional cost of manufacturing these complex mechanisms may require the retail sale price of the pens to be too high for the pen to compete in the marketplace.

Accordingly, it is an object of the invention to provide a retractable felt-tipped pen which is simple in construction and which may be manufactured in a cost-efficient manner. It is another object of this invention to provide a reliable retractable felt-tipped pen with a simple sealing mechanism which may reliably seal the pen nib within the pen body.

SUMMARY OF THE INVENTION

In one embodiment, a retractable felt-tipped pen includes first and second cylindrical members movable with respect to each other and a nib connected to one of the first and second cylindrical members. A flexible membrane is disposed between the cylindrical members and rotates without substantial displacement to engage the pen nib in a closed condition to seal the pen nib in a closed condition and rotates without substantial displacement to expose the pen nib in a writing condition.

BRIEF DESCRIPTION OF THE DRAWINGS

Certain illustrative embodiments of the present invention will now be described more specifically with reference to the attached drawings, wherein.

DETAILED DESCRIPTION OF THE ILLUSTRATED EMBODIMENTS

Figure 1:
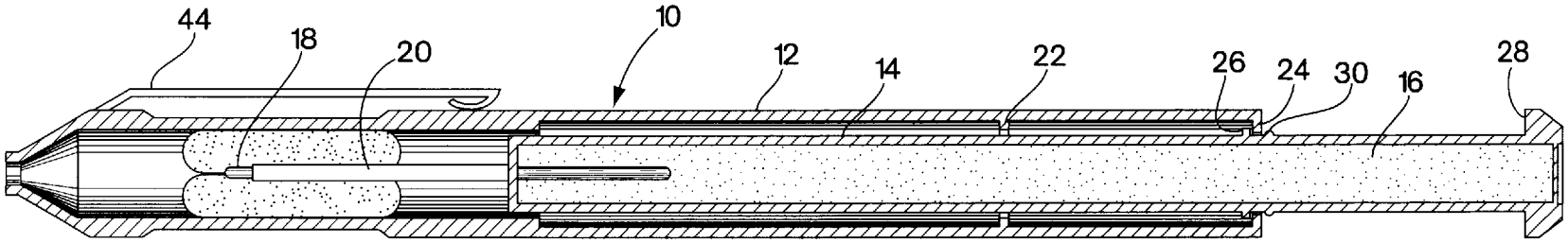
FIG. 1 is a side view, partially cut away, of one embodiment of the pen in a sealed condition.

As shown in FIG. 1, a pen 10 has an outer tubular barrel 12 and an inner tubular barrel 14 which are disposed to be slidable relative to each other. These barrels may be formed of a moldable material such as plastic or other material commonly employed in pens, such as wood or metal or combinations of these materials.

Inner barrel 14 forms an ink reservoir 16 which contains ink to be supplied to a pen nib 18. A pen nib barrel 20 is connected at one end to the inner barrel 14 and supports pen nib 18. Pen nib 18 is exposed at one end of pen nib barrel 20 to form a writing surface and extends through the pen nib barrel 20 into the ink reservoir 16. Ink flows through pen nib 18 and through pen nib barrel 20 to reach the writing surface by gravity and capillary action to maintain the pen nib 18 in a wet condition for application of ink to a writing surface. Optionally, pen nib 18 may be continued wholly within pen nib barrel 20 as long as an internal end of pen nib 18 is in hydrodynamic communication with ink reservoir 16 so that ink may be applied to pin nib 18.

Figure 2:
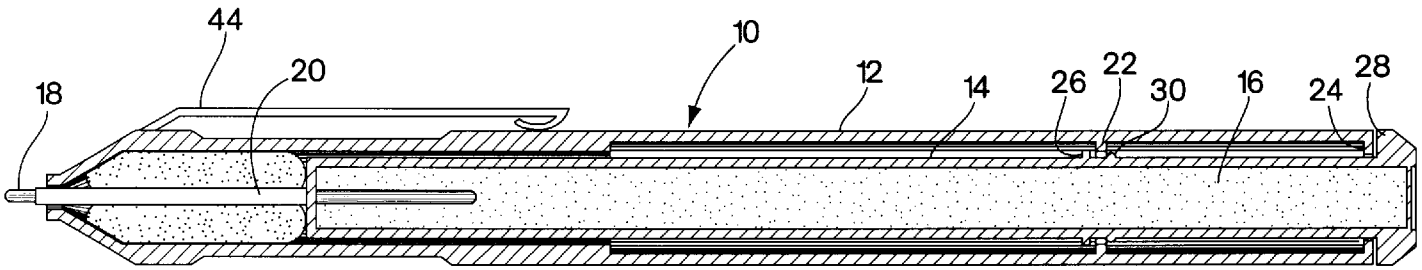
FIG. 2 is a side view, partially cut away, of the pen of FIG. 1 in an open condition.

Forward interlocking protuberance 22 and end interlocking protuberance 24 on the outer barrel 12 cooperate with an interlocking protuberance 26 and end plate 28 on the inner barrel 14 to prevent the inner and outer barrels 14, 12 from separating. An additional locking protuberance 30 is provided on the inner barrel to cooperate with protuberances 22, 24 to maintain the pen in either a locked open position, for writing (FIG. 2), or a locked sealed condition, for storage (FIG. 1). Other known mechanisms for preventing the inner and outer barrels from separating may be used in addition to or as a replacement for these protuberances. The protuberances may be placed along the barrels of the pen to provide structural support in either the open or sealed condition. Additionally, the protuberances may be sized so that it is possible to operate the opening or sealing action of the pen with a single hand.

Figure 14:
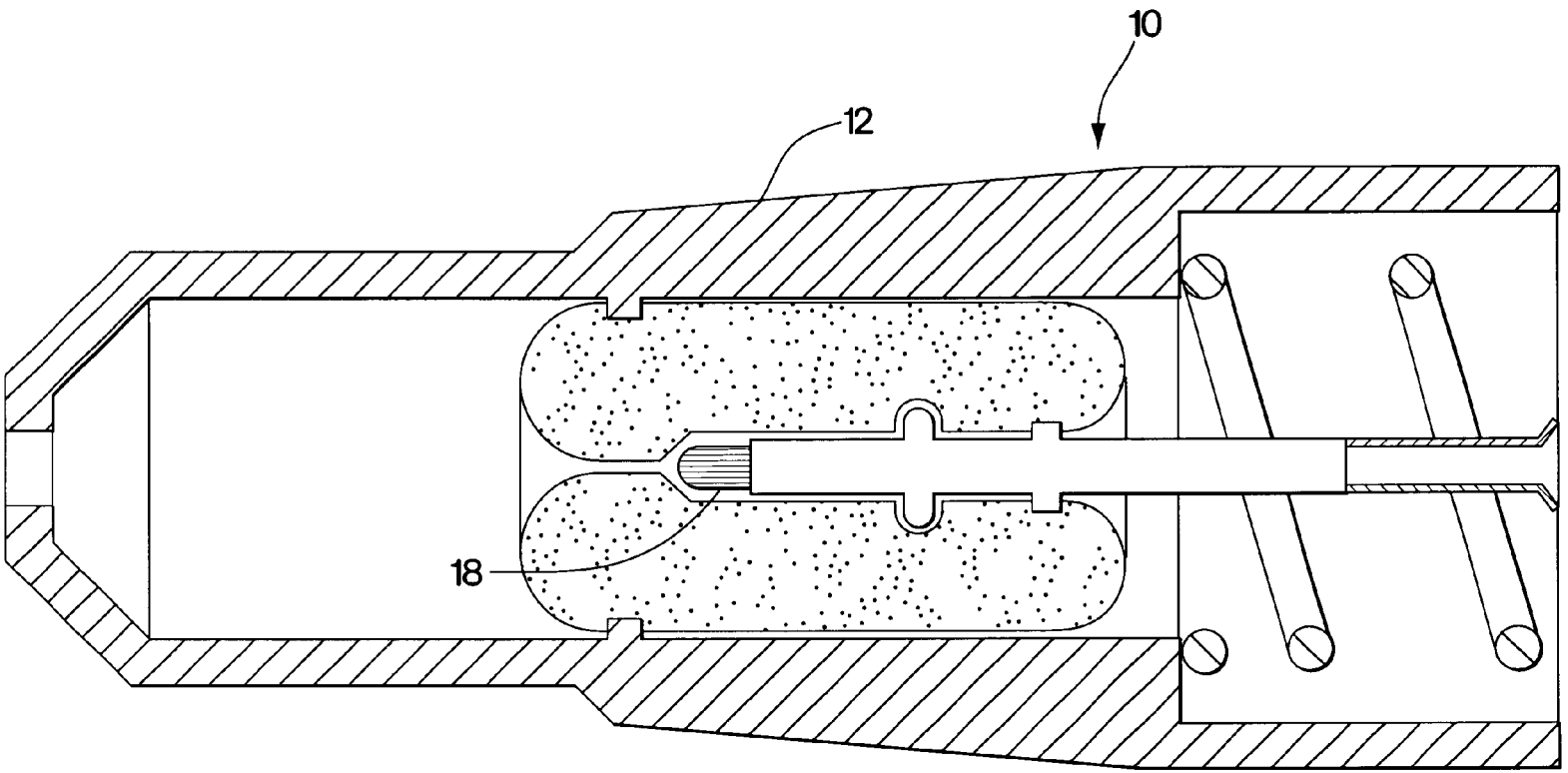
FIG. 14 is an enlarged, cross-sectional view, of an embodiment of the pen according to this invention in a closed condition featuring a spring to mechanically assist deployment or retraction of the pen nib.
Figure 15:
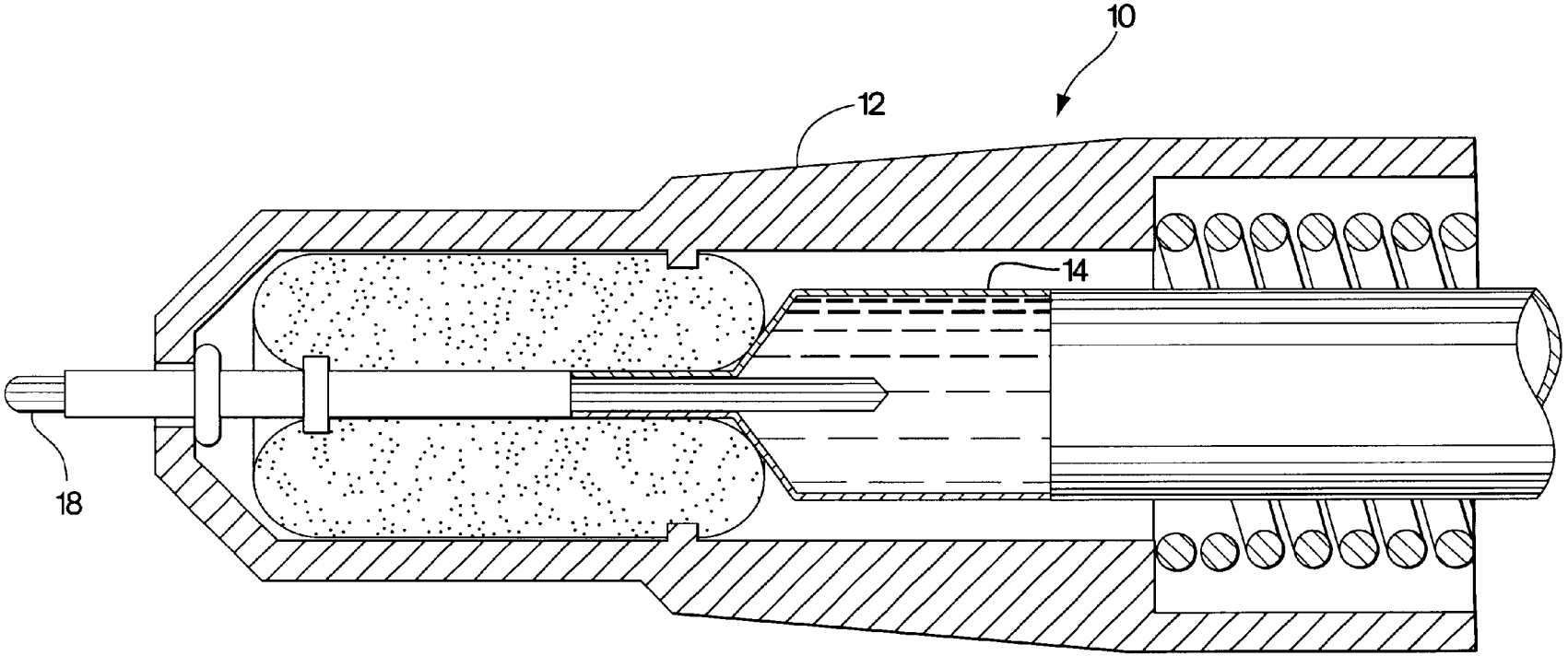
FIG. 15 is an enlarged, cross-sectional view, of the pen of FIG. 14 in a closed condition.

As shown in FIGS. 14 & 15 a, spring may be provided between the outer barrel 12 and the inner barrel 14 to bias the outer barrel 12 and inner barrel 14 relative to each other to mechanically assist retraction or deployment of the pen nib 18. If the spring is used to mechanically assist retraction of the pen nib 18, upon sliding the barrels apart to the writing position, the pen nib 18 is maintained in a writing position by the protuberances, as discussed above. However, a slight displacement of the barrels relative to each other enables the spring to overcome the cooperative restraintive force from the protuberances 22, 30 so that the pen nib will be pulled into pen 10. A similar but reversed scenario applies where the spring is used to bias the pen into a writing position.

The pen 10 may be provided with a retraction/deployment mechanism (not shown), such as a standard spring and ratchet retraction mechanism, commonly used on ball point pens. Alternatively, a thumb operated sliding part, connected to or part of the inner barrel, may be located along the side of the outer barrel in a slot allowing free sliding movement. This sliding movement causes the displacement of the inner barrel 14 relative to the outer barrel 12 to activate the sealing mechanism and deploy or retract the pen nib 18. The thumb also slides the pen nib and inner barrel into the locked writing position. One benefit of this type of movement is that the pen remains a constant length.

A twisting screw action retraction mechanism, such as employed by pens manufactured by the Cross Pen Co., may also be adapted to work with this sealing device, since the underlying principle of operation remains the same—that is, two barrels slide relative to each other. The barrels can be of similar or dis-similar length.

In a yet further alternative, a time-release mechanism, either mechanical or otherwise designed, may be used to automatically close the pen when not in use for a given period of time. One such time-release mechanism involves a spring and a resistive element, such as friction, to gradually retract the pen nib.

The sealing mechanism of the retractable felt-tipped pen will now be described more particularly with reference to FIGS. 3 and 4. As shown in FIG. 4, a flexible tubular membrane 32 is provided between the outer barrel 12 and the pen nib barrel 20. The flexible membrane 32 is attached at a first location 34 to the outer barrel 12 and at a second location 36 to the felt nib barrel 20. The flexible membrane 32 may be attached at these locations by suitable adhesive, mechanical attachment or other bonding method such as ultrasonic bonding. It may be possible for friction alone to hold the seal in a static location. Indeed, this may be preferable in certain applications, such as where the pen is designed to use disposable cartridges (which must be replaced from time to time).

Figure 3:
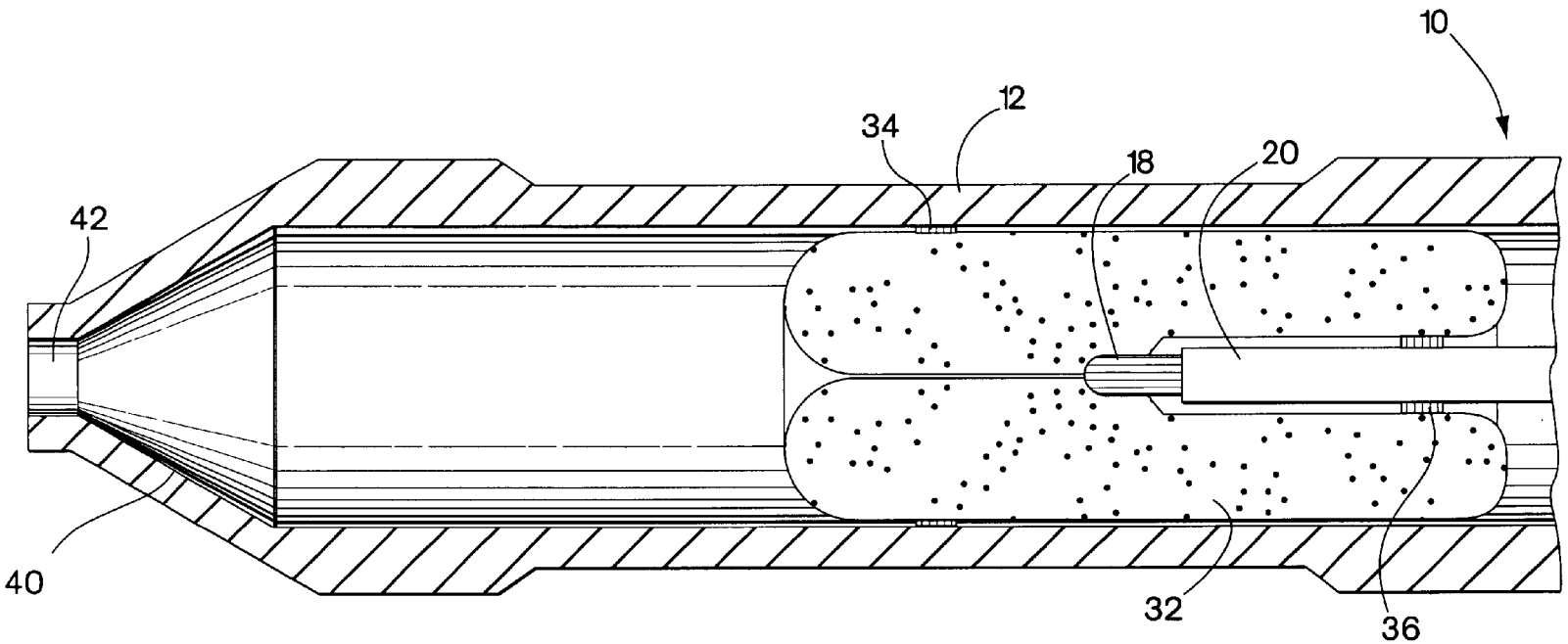
FIG. 3 is an enlarged, cross-sectional view, of the sealing mechanism of the pen of FIG. 1.
Figure 4:
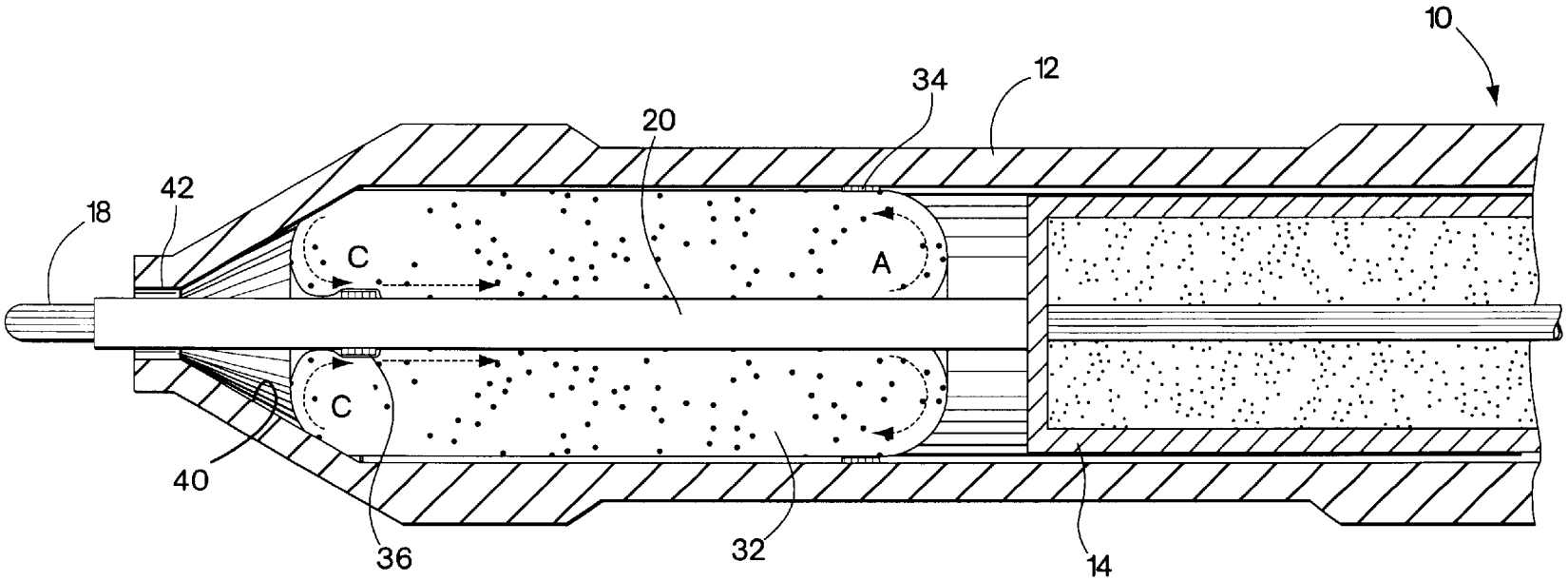
FIG. 4 is an enlarged, cross-sectional view, of the sealing mechanism of the pen of FIG. 2.

FIG. 4 shows the pen 10 in an open condition and FIG. 3 shows the pen 10 in a closed condition. As shown in FIG. 3, when the felt nib 18 is displaced from a writing position, as shown in FIG. 4, to a sealed position, as shown in FIG. 3, (retracted), the second location of attachment to the pen nib barrel 36 moves together with the inner surface of the flexible membrane 32 so that the flexible membrane 32 undergoes a rolling motion without undergoing substantial displacement. Stating that the flexible membrane "does not undergo substantial displacement", as used herein, means that at least one point on the membrane remains substantially constant with respect to the outer barrel, and that at least one point on the membrane remains substantially constant with respect to the pen nib barrel. These two points may move relative to each other.

In operation, while retracting the pen nib 18, point B moves to the right in FIG. 4, causing the surface at point A to move up toward the outer barrel 12 and causing point C to move down to engage the surface of the pen nib barrel 20. This rolling action will continue until the pen nib 18 is completely sealed by the flexible membrane 32 as shown in FIG. 3. In this manner, flexible membrane 32 completely surrounds the fibers of the felt tip, preventing the drying of these fibers. Since the flexible sealing membrane completely surrounds the pen nib 18 in a closed condition, it prevents the infiltration of air to the felt tip both from the end closest to the writing opening and from within the pen body from between the inner barrel 12 and outer barrel 14. An opposite process occurs during the deployment operation of pen nib 18.

The flexible sealing membrane 32 is formed as a donut shaped membrane and may contain a fluid or gas having a positive internal pressure, reducing the effective inner diameter of the donut shape to nothing. The flexible sealing membrane 32 may have several desirable features. First, the membrane 32 may be flexible so that it freely revolves as the outer surface replaces the inner surface, and the inner surface replaces the outer surface. Second, the membrane 32 should be able to engulf the nib so that it will form a seal when the nib is enclosed by the flexible membrane 32.

Several alternative designs for the flexible membrane 32 are contemplated. One possibility uses a suitable plastic or elastomeric material to form a flexible outer membrane, like a latex balloon, in the shape of a donut filled with a liquid or gas under pressure. The "balloon" may be made of rubber, latex, neoprene, plastic, or any material which is expandible, flexible and can hold its original shape. The balloon may be unfilled, or may be filled with air or a fluid such as water, silicone jel, or any appropriate fluid which enables the flexible membrane to retain an appropriate shape.

Figure 5:
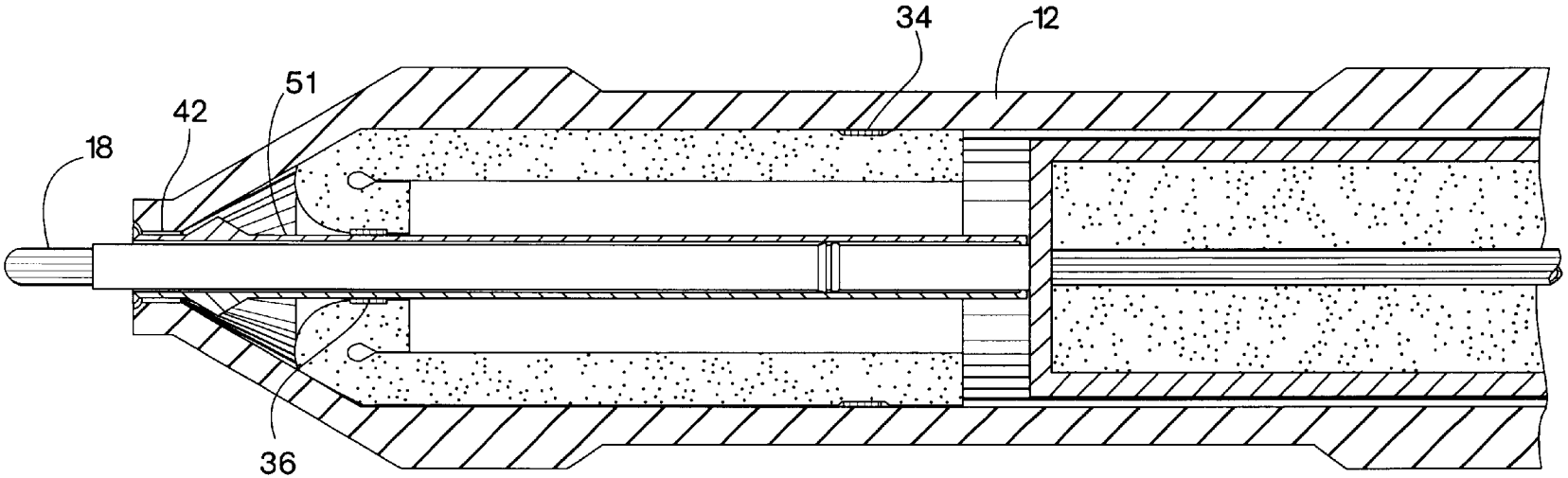
FIG. 5 is an enlarged, cross-sectional view, of an embodiment of the pen according to this invention using a retractable sleeve and a zero diameter neoprene tube in an open condition.

Another possibility for the seal would be a tube having a zero inch interior diameter made out of neoprene or similar material. The two ends of this tube turn inside-out and adhere to each other forming an elongated donut shape. Several advantages are apparent with this neoprene solution. First, there would be no possibility of liquid leaking from the sealing membrane, as the membrane and the pressurizing medium are one and the same. Neoprene is highly resistant to chemical failure from a wide range of inks, thus damage to the seal by chemically aggressive inks is not likely. Further, the manufacturing process for reversing a neoprene tube would be simple and inexpensive. The neoprene tube solution would also be effective if the tube was inside-out, as in the previous example, but not necessarily adhered to itself. In this case, as shown in FIG. 5, the tube would resemble a rolled up shirt sleeve. The large free end of the reversed tube adheres directly to the inner surface of the outer pen barrel at 34. The small free end of the tube adheres to the outer surface of the inner pen barrel at 36. In this configuration, it would not be necessary to have the tube adhered to itself to make a continuous loop or donut shape. A minute quantity of lubricant may be provided on surfaces of the flexible sealing membrane 32 away from the pen nib 18 to minimize friction associated with opening and closing the pen.

Referring to FIGS. 3 & 4, the flexible sealing membrane 32 preferably adheres to the outer surface of the felt tip barrel 20 just behind the base of the fibrous portion of the nib 18, at position 36.

The angled walls 40 of the outer barrel 12 guide the nib 18 and the nib barrel 20 to an opening 42 at the tip of the outer barrel 12. This funneling action accurately guides the nib 18 to an appropriate writing position. Further, when the nib 18 is fully extended, the outer surface of the pen nib barrel 20 and the inner surface of the opening 42 cooperate to support the pen nib 18 to enable pressures applied to pen nib 18 during writing to be directly absorbed by the pen body, as shown in FIGS. 14 & 15.

A shirt pocket clip 44 (FIGS. 1 & 2) may be provided so that the pen may be easily carried by the user. Providing the shirt pocket clip at the opening end of the pen 10 is further advantageous in that it helps to protect this side of the pen, while using gravity to help ensure that ink flows away from the tip when in storage in a pocket.

Figure 6:
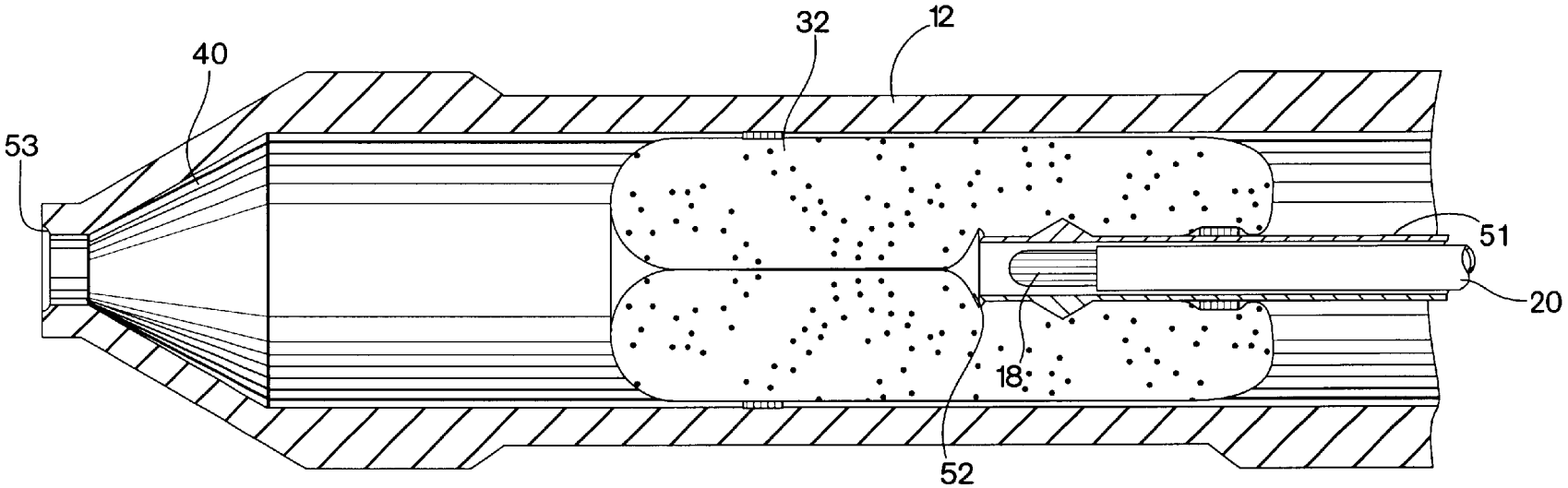
FIG. 6 is an enlarged, cross-sectional view, of an embodiment of the pen according to this invention using a retractable sleeve in a closed condition.
Figure 7:
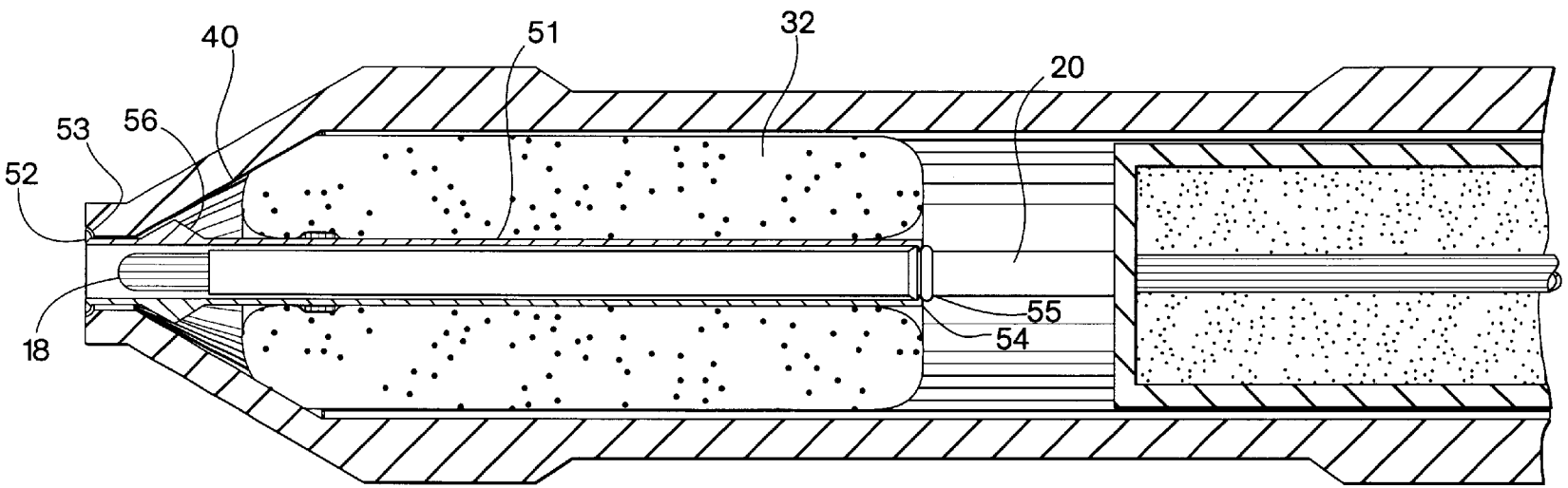
FIG. 7 is an enlarged, cross-sectional view, of the pen of FIG. 6 in a partially closed condition.
Figure 8:
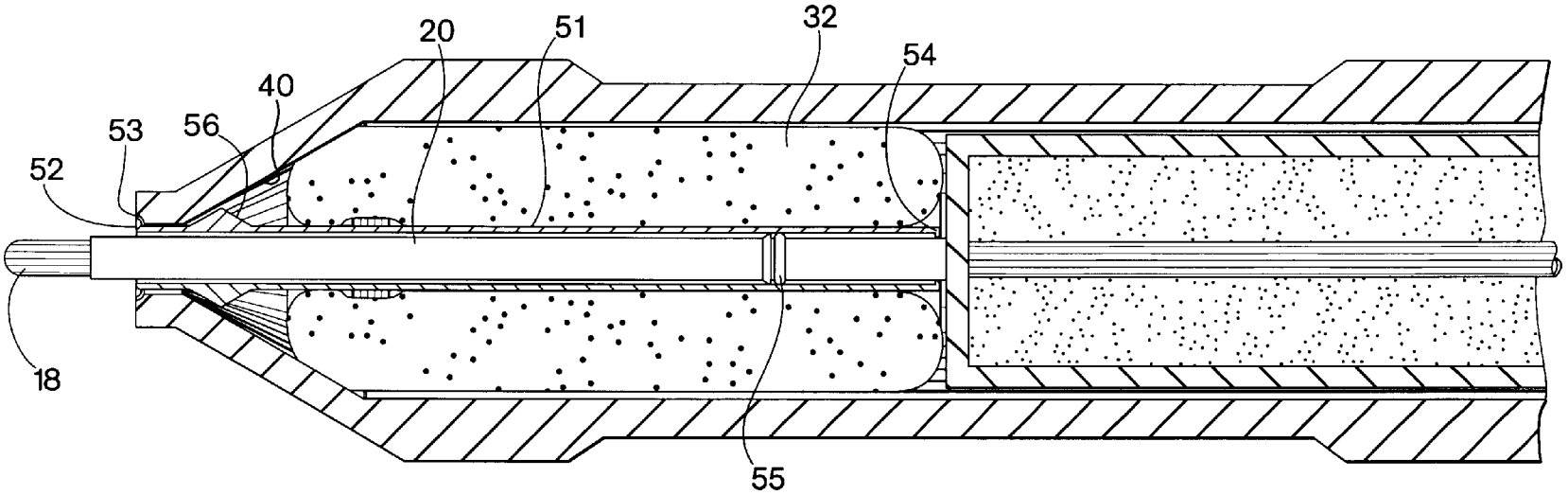
FIG. 8 is an enlarged, cross-sectional view, of the pen of FIG. 6 in an open condition.

A sleeve 51 (illustrated in FIGS. 5, 6, 7 & 8) may be provided to cover the felt tip when in a closed position to prevent ink from leaching onto the flexible membrane 32 or from contaminating the surface of the flexible membrane 32 with ink. As shown in FIGS. 6, 7 & 8, the sleeve slides back when in a writing mode to expose pen nib 18. Sleeve 51 surrounds and is free to move with pen nib barrel 20. By a series of precise crimping and molded protuberances 52, 53, 54 & 55 (FIGS. 7 & 8), sleeve 51 engages the pen nib barrel 20 during retraction to cover pen nib 18. The sleeve 51 then reveals the pen nib when the pen is deployed to a writing position. The sliding sleeve may be formed of plastic, metal, wood or any material which is rigid and can be shaped through molding, turning, casting, or any other method.

The sleeve may be provided with protuberances 52 which engage the inner walls of the outer barrel 12 to lock the sleeve when open. This allows the inner barrel to slide relative to the sleeve until the felt tip is covered. At that point, the sleeve crimp 54 engages a protuberance 55 on the inner barrel 20 as it is moving (FIGS. 6 & 7). The sleeve is pulled away from its locked position on the outer barrel and moves with the inner barrel as it becomes covered by the flexible sealing membrane (FIGS. 8, 7 & 6 in sequence).

In achieving an opened position, FIG. 8, from FIG. 6 and FIG. 7, the sleeve 51 remains stationary, relative to the felt tip nib 18 as the flexible membrane 32 is being peeled away (FIG. 7). When the sleeve angle 56 comes in contact with the angled opening of the inner wall of the outer barrel 40, it stops moving relative to the inner barrel. The felt tip nib 18 is guided with the sleeve 51 through the opening until a protuberance on the sleeve 52 contacts an indentation 53 on the tip of the outer barrel 12. The sleeve is then forced to a locking position when the pen is fully opened, FIG. 8.

Although a sleeve of this nature may be provided, it may not be necessary to provide a sleeve of this nature—since the user is never in contact with any portion of the sealing member, contamination of the sealing member should not affect the performance of the pen negatively. The sleeve is precautionary only.

Figure 9:
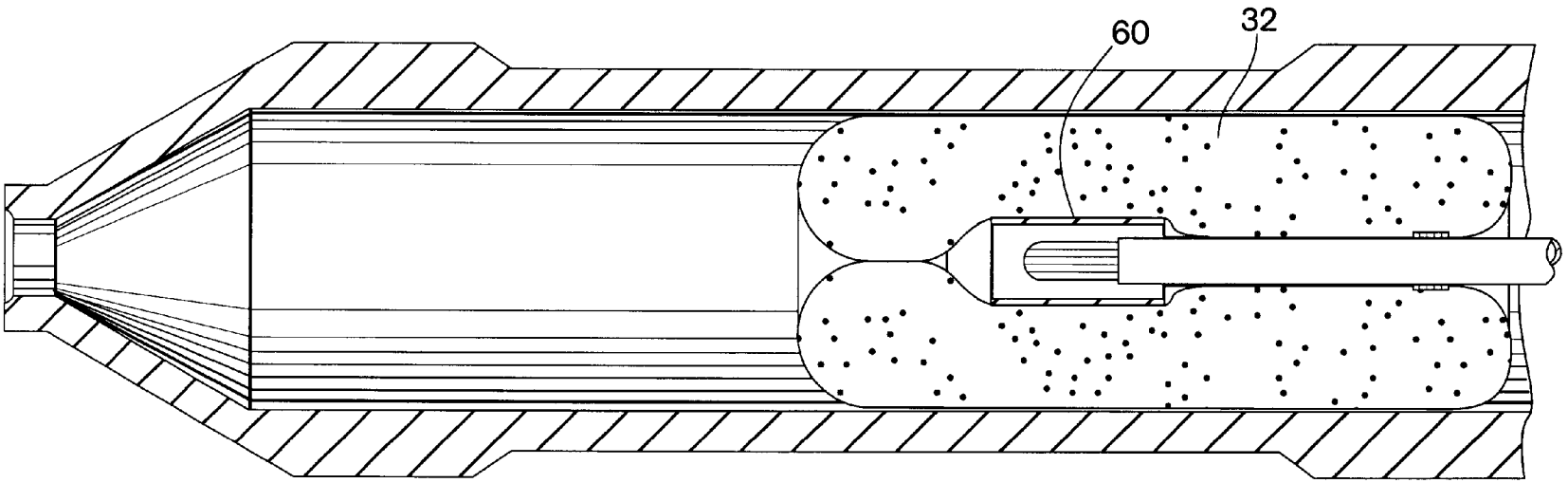
FIG. 9 is an enlarged, cross-sectional view, of an embodiment of the pen according to this invention in a closed condition featuring an indented flexible membrane.
Figure 10:
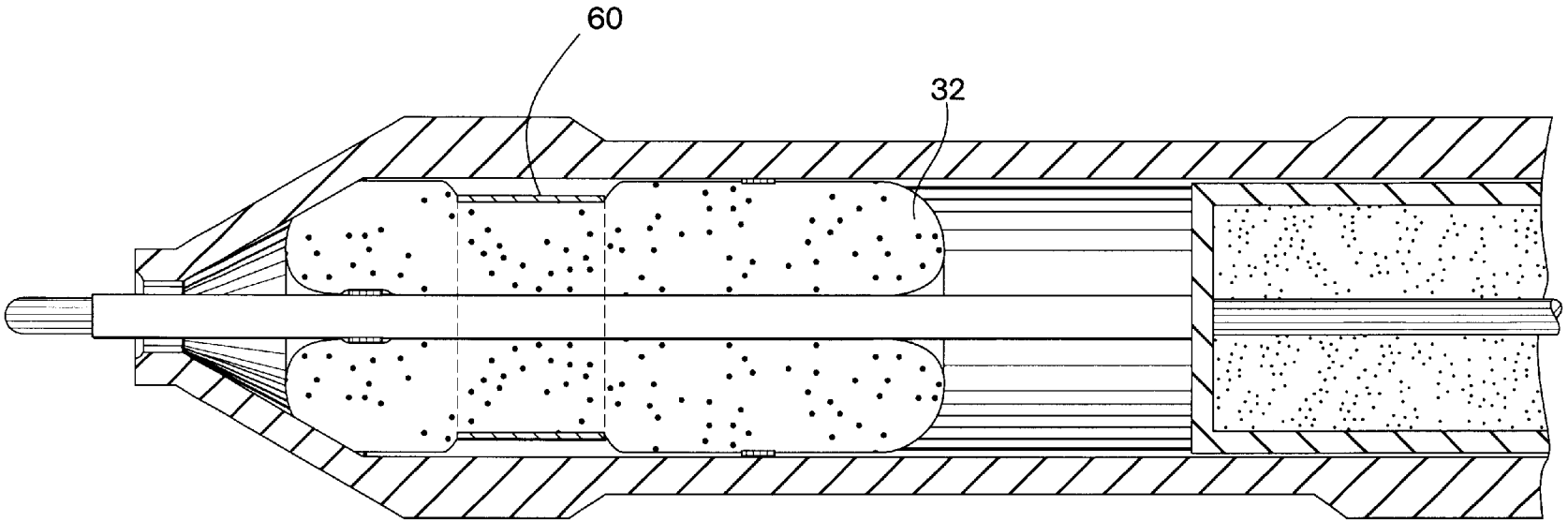
FIG. 10 is an enlarged, cross-sectional view, of the pen of FIG. 9 in an open condition.

Alternatively, as shown in FIGS. 9 & 10, the surface of the flexible membrane 32 may be indented at a location corresponding to the exact position of the felt tip when the pen is in a sealed condition FIG. 9 to form an air space 60 surrounding the pen nib. By forming an air space 60 of this nature, ink from the pen nib can be prevented from contaminating the surface of the flexible membrane. The indentation rolls with the flexible membrane 32.

A yet further alternative to using a sliding sleeve is to use a segmented rigid cylinder, attached to the sealing membrane, to surround the felt tip fibers when in the sealed condition. To facilitate turning back of this cylinder, the cylinder is divided and separated into multiple tessellated tiles or scales. These individual pieces move with the flexible membrane as it is turned back. Each tile or scale is attached separately, but cooperate when sealed to form gap 60. The closest example is the skin of a snake where each scale is individually attached to the skin, separated by flexible connections, which allows the snake to expand when necessary. The effect of this mechanism is similar to the indentation illustrated in FIGS. 9 & 10.

Figure 11:
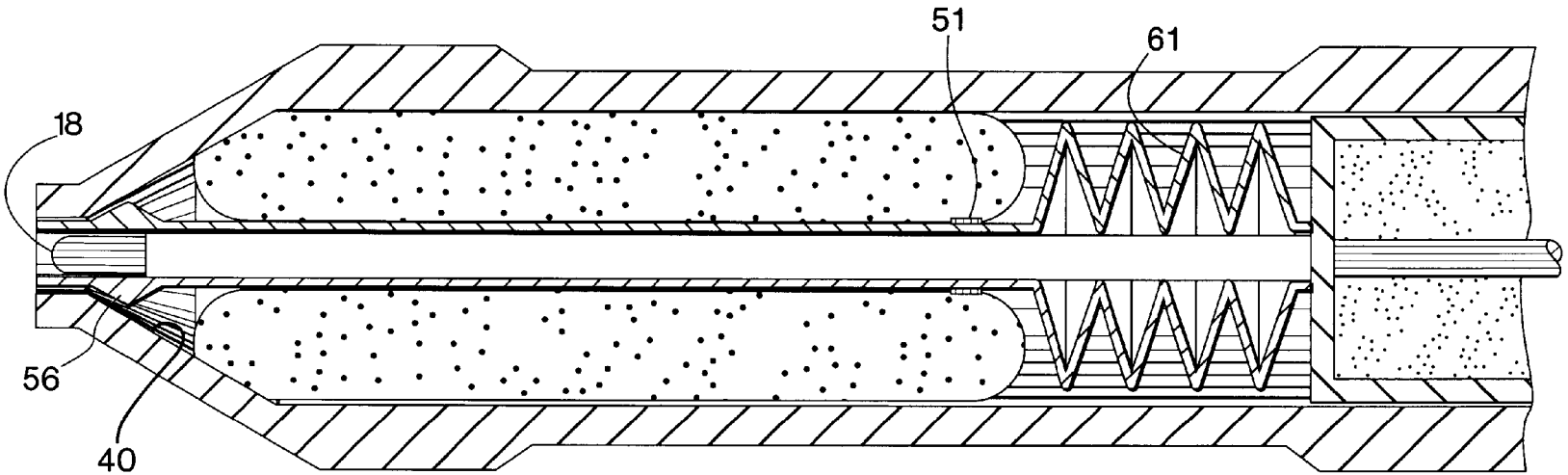
FIG. 11 is an enlarged, cross-sectional view, of an embodiment of the pen according to this invention in a partially closed condition featuring an accordion-like member biasing the sliding sleeve.

Another alternative to providing a sliding sleeve is to fit the pen nib with an accordion-like spring 61 (FIG. 11) which expands to force the sliding sleeve 51 to cover the felt tip fibers when the pen is in a sealed condition. When the pen is opened to expose the pen nib 18, the accordion-like spring forces sleeve 51 up to and against the inner wall of the outer barrel at the pen tip hole. The accordion-like spring is resisted by the contact of the sleeve at point 56 with the outer barrel angle 40 while the inner barrel continues to slide, exposing the pen nib. A reverse process takes place during the sealing process when the pen nib is retracted. The sliding sleeve 51 may be separate from or connected to the accordian-like expanding member 61.

This accordion-like member 61 may be formed from a variety of materials, such as plastics, rubbers or other synthetic and/or naturally occurring materials. The accordion-like member 61 expands by a bellows action to force the sliding sleeve 51 to cover the felt nib 18, and is retracted by bellows action resisting the sliding sleeve thereby revealing the nib 18. This action could also be by simple contraction and/or simple deflection of the material of the accordion-like member 61. In either case, the mechanism involved relies on the property of shape memory inherent in the accordian-like member and its action relative to the covering sleeve. The sleeve may be fixed to or independent of the inner barrel.

Figure 12:
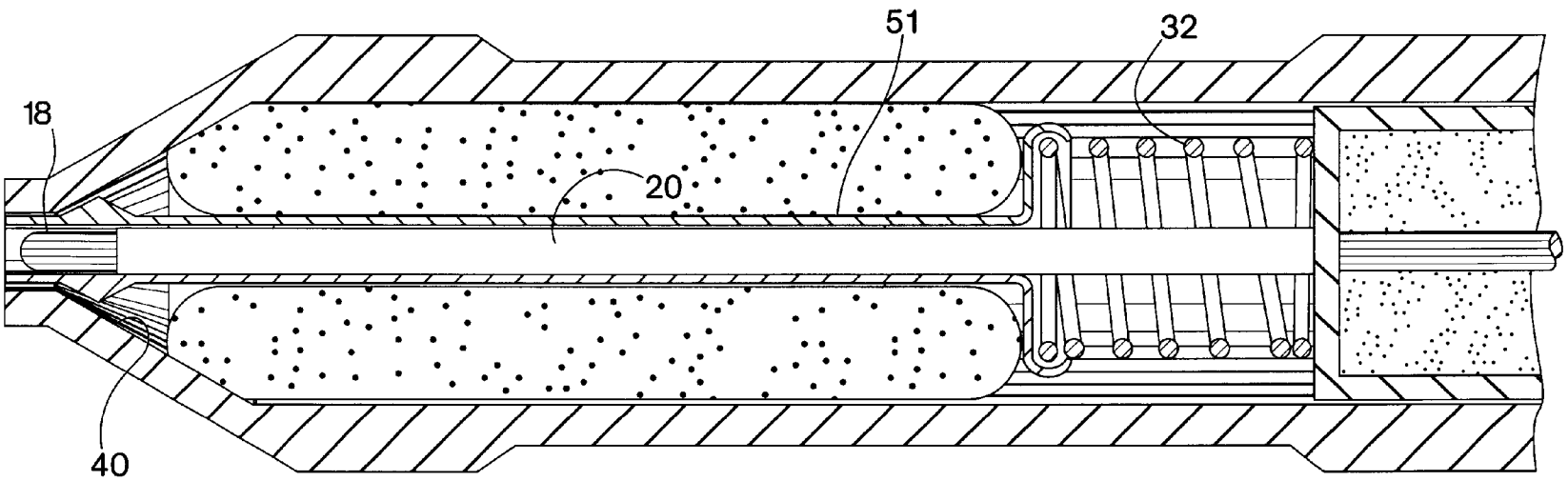
FIG. 12 is an enlarged, cross-sectional view, of an embodiment of the pen according to this invention in a partially closed condition featuring a spring biasing the sliding sleeve.

Alternatively to the bellows action of member 61 is a spring 62 shown in FIG. 12. Like the action of the bellows, the spring 62 forces the sliding sleeve 51 against the walls of the outer barrel 40. Upon retraction, the sliding sleeve is eventually pulled back with the inner barrel 20 to cover the felt nib 18.

Figure 13:
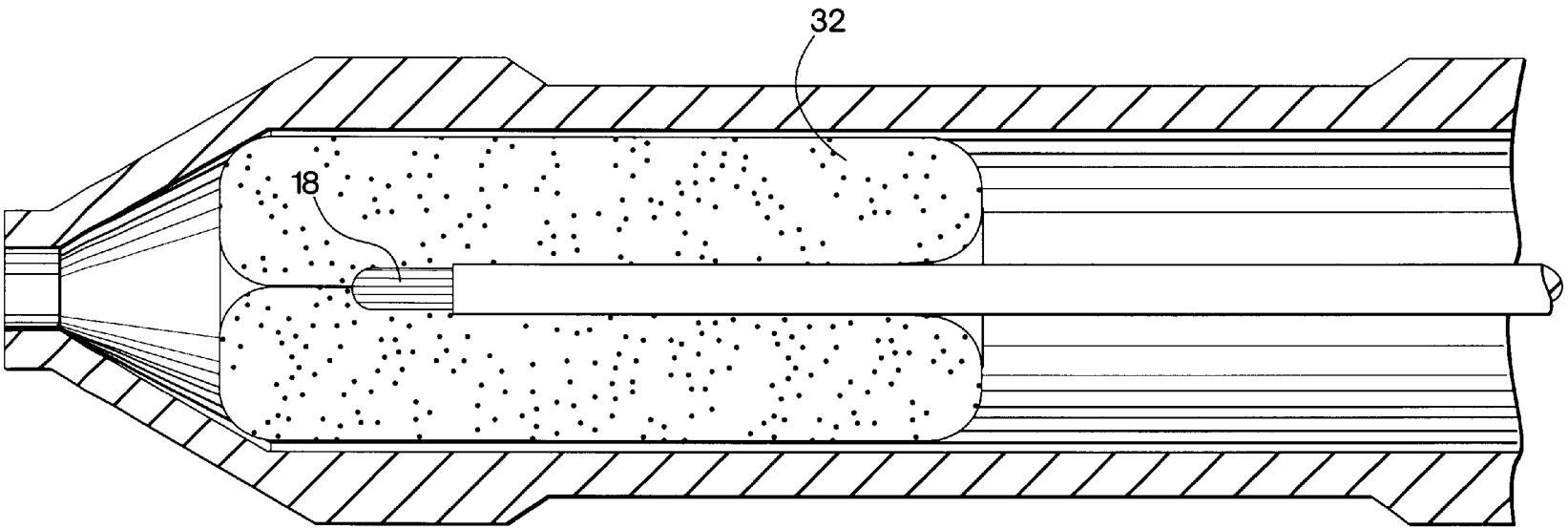
FIG. 13 is an enlarged, cross-sectional view, of an embodiment of the pen according to this invention featuring a non-rotating flexible member.

FIG. 13 illustrates a sealing member 32 which expands to seal nib 18 without any rotating action. This mechanism may or may not be used in conjunction with separate sliding sleeves as previously described. In this instance, a quantity of pen ink will bleed onto the surface of the sealing member 32 to enable the pen nib 18 and pen nib barrel 20 to easily slide within sealing memebr 32.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What I claim is:

1. A retractable pen, comprising:

a first tube;

a second tube slidable relative to said first tube;

a pen nib connectably retained by one of said first and second tubes; and a flexible membrane formed of a tube of resilient material and having a self-sealing passage therethrough, an outer surface of said flexible membrane being affixed to one of the tubes and an interior surface of said flexible membrane being coupled to said pen nib to allow a first end of the flexible membrane to be pulled into and substantially through the self-sealing passage, said flexible membrane being disposed in one of said first and second tubes and movable relative thereto, such that the pen nib may move into a first position whereby said pen nib is contained by a seal formed by said self-sealing passage, and may move into a second position whereby said pen nib is exposed and not contained by said seal.

2. A retractable pen according to claim 1, wherein the pen nib includes a felt tip nib.

3. A retractable pen according to claim 1, wherein the flexible membrane comprises neoprene.

4. A retractable pen according to claim 1, wherein the flexible membrane includes a tube formed of a resilient material and having a self-sealing passage therethrough and being slidably movable within either the first or second tube.

5. A retractable pen according to claim 1, wherein the pen nib comprises a disposable pen cartridge.

6. A seal for sealing a movable nib, comprising a first tube; and a second tube disposed within the first tube and being formed of a resilient material for providing a self-sealing passage therethrough, and having an exterior surface fixed to at least one location to the first tube said exterior surface being slidably movable relative to said first tube, and having an interior surface adapted to be coupled to the movable pen nib, whereby the movable nib can be moved through the self-sealing passage to move between a sealed condition and an exposed condition.

7. A seal according to claim 6, wherein the second tube has an exterior surface affixed to the first tube.

8. A method for manufacturing a retractable pen, comprising providing a tube;

providing a pen nib retained by the tube;

disposing a flexible membrane having a self-sealing passage within the tube and slidably movable relative thereto, fixing at least one location on an exterior surface of the flexible membrane to the tube, and coupling at least one location on an interior surface of the flexible membrane to the pen nib, such that the pen nib may move into a first position whereby said pen nib is contained by said seal, and may move into a second position whereby said pen nib is exposed and not contained by said seal.

9. A method according to claim 8, wherein providing a flexible membrane includes providing a membrane having a cavity formed therein.

10. A method according to claim 8, wherein providing a pen nib includes providing a pen nib within a disposable pen cartridge.

* * * * *